US008011890B2

(12) United States Patent
Walters et al.

(10) Patent No.: US 8,011,890 B2
(45) Date of Patent: Sep. 6, 2011

(54) AIR-COOLED COMPONENT

(75) Inventors: Sean A. Walters, Bristol (GB); Kevin P. Self, Bristol (GB); Brian G. Cooper, Derbyshire (GB)

(73) Assignee: Rolls-Royce PLC, London (GB)

( * ) Notice: Subject to any disclaimer, the term of this patent is extended or adjusted under 35 U.S.C. 154(b) by 901 days.

(21) Appl. No.: 11/976,296

(22) Filed: Oct. 23, 2007

(65) Prior Publication Data

US 2008/0131284 A1 Jun. 5, 2008

(30) Foreign Application Priority Data

Nov. 30, 2006 (GB) ..... 0623908.1

(51) Int. Cl.
*F01D 11/00* (2006.01)

(52) U.S. Cl. ..... 416/97 R

(58) Field of Classification Search ..... 416/90 R, 416/92, 97 R

See application file for complete search history.

(56) References Cited

U.S. PATENT DOCUMENTS

| | | | |
|---|---|---|---|
| 3,045,965 | A | 7/1962 | Bowmer |
| 3,527,543 | A | 9/1970 | Howald |
| 5,503,529 | A | 4/1996 | Anselmi et al. |
| 6,036,436 | A | 3/2000 | Fukuno et al. |
| 2006/0002796 | A1 | 1/2006 | Bolms et al. |

FOREIGN PATENT DOCUMENTS

| | | | |
|---|---|---|---|
| EP | 0 894 946 | A1 | 2/1999 |
| EP | 1 553 261 | A2 | 7/2005 |
| EP | 1 614 859 | A1 | 1/2006 |
| EP | 1 655 453 | A1 | 5/2006 |

OTHER PUBLICATIONS

European Search Report issued in EP Application No. 07 25 4068 on Dec. 7, 2007.

*Primary Examiner* — Edward Look
*Assistant Examiner* — Dwayne J White
(74) *Attorney, Agent, or Firm* — Oliff & Berridge, PLC

(57) ABSTRACT

An air-cooled component such as a turbine stator vane, has a row of cooling passages extending from the interior of the vane to the exterior. The passages are inclined to a plane perpendicular to the row. The angle of inclination of each passage varies with the position of the passage along the row. The arrangement assists in avoiding local overheating of the vane surface.

10 Claims, 2 Drawing Sheets

AIR-COOLED COMPONENT

This invention relates to an air-cooled component and is particularly, although not exclusively, concerned with air-cooled components of a gas turbine engine, such as turbine blades and stator vanes.

It is known for turbine stator blades to be formed with a hollow aerofoil section, so that the vanes can be cooled by supplying cooling air to the interior of each vane from its radially inner and outer ends. Passages are provided in the vane wall, through which the cooling air flows from the interior of the vane to the hot gas flow passing through the engine. The cooling air extract heats from the vane as it flows through the passages, and, on exiting the passages, forms a film over the external surface of the vane to shield the vane from the hot gases.

In order to maximise heat transfer from the vane to the cooling air, it is considered important for the passages to be as long as possible, and consequently they pass obliquely through the vane wall, rather than being oriented perpendicularly to the vane wall. At the leading edge of the vane, the passages are formed obliquely as viewed in a common plane containing the leading edge and the engine axis. That is to say, the inner and outer ends of each passage are at different radial distances from the engine axis. It is known for the passages in each row at the leading edge of the vane to be in two groups, or banks, disposed one radially inwardly of the other. The passages in each bank are inclined at the same angle as one another, but the passages in one bank are inclined in the opposite sense to those in the other bank, with respect to a plane parallel to the engine axis and passing through the leading edge of the vane.

Problems can arise in the manufacture of vanes with the known arrangement of cooling passages at the leading edge. At the junction between the two banks of passages, a build up of tolerances can mean that the distance on the aerofoil external surface between the exits of the endmost passages of the two banks can vary. Also, other manufacturing difficulties can arise, and problems can occur if an internal partition is not accurately disposed between the two banks of passages.

In side walls of known vanes, away from the leading edge, the passages lie parallel to a plane extending transversely of the vane span, so that the inlet and exit of each passage is at the same radial distance from the engine axis. However, the direction of each vane has a component directed axially, so that the inlet is upstream from the exit with respect to gas flow past the exit. Cooling air issuing from the passage exit thus causes minimum disruption of the flow of hot gas over the vane.

Because the passage in the vane side walls have an axial extent, adjacent rows of passages cannot be placed close to each other without creating the danger that the passages of one row may overlap with those of another. This can lead to an inadequate number of rows of passages in the side walls, leading to overheating in operation.

According to the present invention there is provided an air-cooled component having a wall provided with cooling passages extending through the wall, the cooling passages being disposed in a row, characterised in that the angle between each passage and a plane perpendicular to the direction of the row varies with the position of the passage along the row, the passages being disposed in two groups extending in opposite directions from a common point along the row, the passages in each group being inclined to the said plane in the opposite sense from those in the other group, the component having a hollow aerofoil portion, the passages extending from the interior of the aerofoil portion to the exterior of the component, characterised in that an internal partition is disposed within the interior of the aerofoil portion, substantially at the level of the common point.

Consequently, in an embodiment in accordance with the present invention, the angle of inclination of the passages varies gradually from passage to passage, so that there is no major change in angle between adjacent passages or between two banks of passages.

The passages of the row are preferably disposed in two groups or banks, extending in opposite directions from a common point along the row of passages, with the passages in one group being inclined to the said plane in the opposite sense from those in the other group. The angle between each passage and the said plane may increase in the direction away from the common point, for example from approximately 0° to approximately 60°.

Each passage may be inclined to the said plane at a different angle from all other passages in the row. In this respect, a "different angle" includes an angle of the same magnitude but in the opposite sense.

The component may have a hollow aerofoil portion, in which case the passages may extend from the interior of the aerofoil portion to the exterior of the component. The row of passages may extend in the spanwise direction of the aerofoil portion. The passages may emerge at the leading edge of the aerofoil portion, or at a side wall of the aerofoil portion away from the leading edge.

The passages may be disposed so that their directions converge towards a region situated upstream of the aerofoil portion. If the passages are disposed in two groups extending in opposite directions from a common point along the row of passages, the common point may be situated approximately midway along the aerofoil portion in the spanwise direction. Supply means for cooling air may be provided at opposite ends of the aerofoil portion.

The interior of the aerofoil portion may be provided with a partition which is situated, in the spanwise direction of the aerofoil portion, approximately at the level of the common point.

The row of passages may comprise an upstream row and there may be a downstream row of passages situated in the wall of the aerofoil portion at a position downstream of the upstream row, the passages of the downstream row being offset, with respect to the passages in the upstream row, laterally of the flow direction along the wall, in use, of cooling air emerging from the passages of the upstream row.

For a better understanding of the present invention, and to show more clearly how it may be carried into effect, reference will now be made, by way of example, to the accompanying drawings, in which:—

Figure 2:
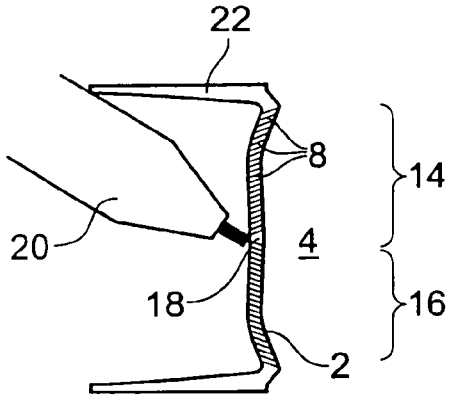
FIG. 2 (Prior Art)
FIG. 2 (PRIOR ART) illustrates diagrammatically a step in a manufacturing process of a known stator vane.
Figure 3:
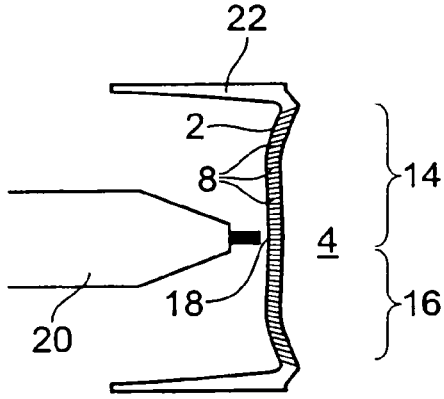
Figure 4:
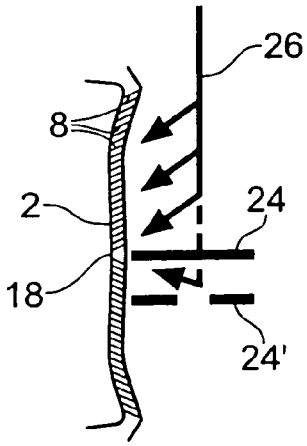
FIG. 4 (Prior Art)
Figure 5:
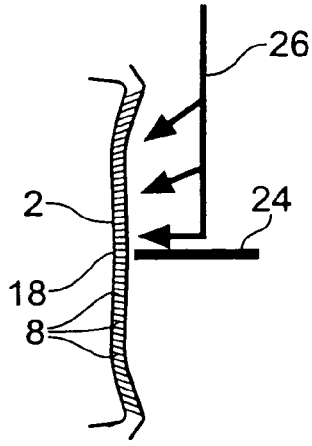
Figure 6:
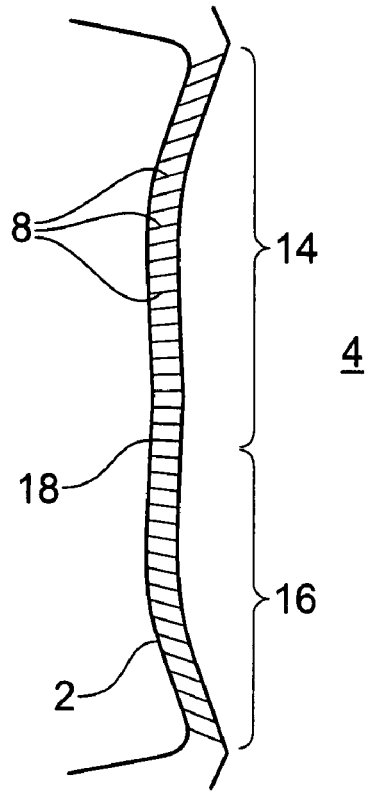
Figure 7:
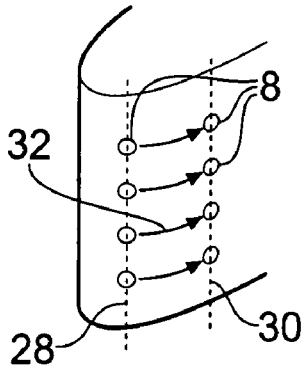
FIG. 7 (Prior Art)
Figure 8:
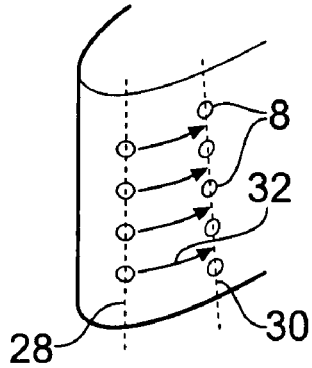

FIG. 3 corresponds to FIG. 2, but shows a stator vane in accordance with the present invention;

FIG. 4 (PRIOR ART) represents cooling air flow, in use, in a known stator vane;

FIG. 5 corresponds to FIG. 4, but shows a stator vane in accordance with the present invention;

FIG. 6 is an enlarged view of the stator vane shown in FIGS. 3 and 5;

FIG. 7 (PRIOR ART) represents flow from cooling passages in a known stator vane; and FIG. 8 corresponds to FIG. 7 but shows a stator vane in accordance with the present invention.

Figure 1:
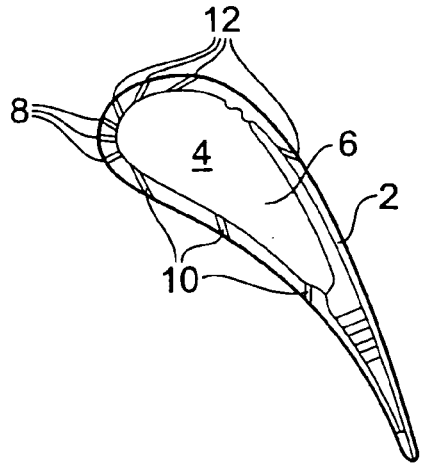
FIG. 1( Prior Art)
FIG. 1 (PRIOR ART) is a sectional view through an aerofoil portion of a turbine stator vane of a gas turbine engine.

The vane shown in FIG. 1 comprises an aerofoil portion 2 which is hollow, and so defines an internal cavity 4. The cavity 4 is sub-divided by a perforated partition 6, which serves to control cooling air flow within the cavity 4.

Cooling passages 8, 10, 12 are formed in the wall 2. The passages 8 are situated at or close to the leading edge of the vane (with respect to the direction of gas flow over the vane in use), passages 10 are situated in the side wall of the vane on the pressure side, and passages 12 are situated in the side wall on the suction side.

In operation of a gas turbine engine in which the vane is installed, cooling air is supplied to the cavity 4 from opposite ends of the aerofoil portion. The cooling air passes from the cavity 4 to the exterior of the vane through the passages 8, 10, 12. Combustion gases forming the working fluid of the engine flow over the vane subjecting it to very high temperatures. The cooling air passing through the passages 8, 10, 12 cools the vane by heat transfer from the material of the vane to the air as it flows through the passages. To maximise heat transfer in known vanes, the length of each passage 8, 10, 12 is maximised by inclining it to the direct perpendicular direction across the wall 2 at the location of the respective passages. This is apparent in FIG. 1 for the passages 10 and 12, since they are inclined in a plane which is parallel to the engine axis, and extends transversely through the aerofoil portion of the vane. These passages 10, 12 are inclined so that the passage inlets, within the cavity 4, are upstream of the exits, with reference to the flow of working gas over the vane. As a result of this orientation of the passages 10, 12, cool air exiting the passages substantially forms a film over the external surface of the wall 2, protecting the material of the vane from the hot working gas.

The passages 8 at the leading edge of the vane are directed approximately perpendicular to the wall 2 as seen in FIG. 1, but are inclined to the plane of FIG. 1 as represented in FIG. 2, which illustrates a known arrangement of passages 8. It will be appreciated from FIG. 2 that, in the known vane, the passages 8 lie in a row which extends spanwise down the leading edge of the vane, and are arranged as two banks 14, 16, which meet at a common point 18. When the vane is installed in an engine, the bank 14 is situated radially outwardly of the bank 16. It will be appreciated from FIG. 2 that the passages 8 in the bank 14 are inclined, as seen in a plane containing the engine axis and the row of passages 8, so that the inlet of each passage 8 is disposed radially outwardly of the exit. The reverse is true for the passages in the bank 16, whose inlets are situated radially inwards of the exits.

It will be appreciated that, for the known vane shown in FIG. 2, the radially outer passages 8 of the bank 14 and the radially inner passages 8 of the bank 16 converge towards each other. The passages 8 are formed by using an electrical discharge machining process employing an electrode 20, or by a laser drilling operation. The electrode 20 forms all of the holes of one bank 14, 16 at a common angle of, for example, 45°, and is then rotated through 90° to form the passages 8 of the other bank 14, 16. At the transition of the electrode 20 between the banks 14, 16, manufacturing tolerances, and positioning tolerances of the electrode 20, can result in the adjacent passages 8 of the banks 14, 16 having exit openings which are too close together or too far apart, for optimum vane cooling. For example, it is possible for the exits of the adjacent passages 8 of the banks 14, 16 to overlap one another, resulting in excessive cooling at the common point 18. Alternatively, the exits of these passages 8 may be separated by an unacceptably large gap, which leads to undercooling at the common point 18.

Furthermore, as indicated in FIG. 2, the formation of the passages 8 at the appropriate angle may cause interference between the electrode 20 and an overhanging shroud portion 22 of the vane. A further problem shown in FIG. 4, can arise if an internal partition 24 is positioned within the cavity 4 to control cooling air flow from the opposite ends of the aerofoil portion of the vane. As shown as a full line, the partition 24 is intended to be installed at a radial position along the length of the aerofoil portion of the vane so that it lies at the level of the common point 18 between the banks 14, 16. The result is that the radially outer bank 14 is supplied with cooling air solely from the radially outer end of the aerofoil portion of the vane, while the radially inner bank 16 is supplied solely from the radially inner end of the aerofoil portion. However, if the partition 24 is positioned at a location radially displaced from the common point 18, for example as shown in broken outline at 24', it will be appreciated that some of the passages 8 of the lower bank 16 receive cooling air from the radially outer end of the aerofoil portion.

The orientation of the passages 8 is established so that the cooling air flow needs to be deflected only by 45° from its entry direction into the cavity 4, so as to pass through the passages 8. However, as a result of the incorrectly positioned partition 24', the incoming air flow 26 needs to be deflected, adjacent the partition 24' through 135° in order to flow through the passages 8 of the radially inner bank 16. This deflection causes a loss of kinetic energy of the air, so reducing its flow rate through the radially outer passages 8 of the radially inner bank 16, potentially causing undercooling of the vane.

In accordance with the present invention, as illustrated in FIGS. 3 and 5, the passages 8 are formed by the electrode 20 or by laser drilling so that the angle of inclination varies in small steps from passage to passage. As a result, there is no sudden transition of the orientation of the passages, as there is at the common point 18 in the known vane of FIG. 2, where the adjacent passage 8 differ in orientation from each other by 90°. It is consequently easier to avoid unacceptably large or small gaps between the exits of adjacent passages. It nevertheless remains the case that the passages 8 can be regarded as forming two banks 14, 16, with the passages 8 in the bank 14 having their inlets situated radially outwards of their exits, and the passages 8 in the bank 16 having their inlets situated radially inwardly of their exits. Thus, the angles of inclination of the passages 8 of the radially outer bank 14 are inclined in one sense with respect to a plane perpendicular to the direction of the row of passages 8, while those in the bank 16 are inclined relatively to that plane in the opposite sense.

It will be appreciated that the passages 8 near to the common point 18 between the banks 14, 16 extend perpendicularly, or almost perpendicularly, to the wall 2 at that location. The heat transfer effectiveness of these passages is consequently compromised, but it is considered that the even distribution of cooling passages 8 in this region nevertheless improves the overall cooling effectiveness of the arrangement of passages. Consequently, a vane having cooling passages 8 arranged as shown in FIG. 3 is less likely to be rejected, require re-working, or to overheat than a vane with cooling passages 8 arranged as shown in FIG. 2, despite the shorter passage length available for heat transfer in the centre of the span of the vane.

Furthermore, as shown in FIG. 5, a minor error in the radial positioning of the partition 24 has less severe consequences than in the passage geometry shown in FIG. 4. It will be appreciated that, since there is no large step change in the angular orientation of adjacent passages 8, there is minimal requirement for any significant reversal of the direction of air flow 26 in the cavity 4 in order to go through passages 8.

FIG. 6 indicates the angular orientation of the holes 8. It will be appreciated that, at the radially outer ends of the aerofoil portion, at which cooling air is supplied, the passages 8 are inclined at approximately 60°, providing minimum deflection of the incoming air travelling at its highest velocity. Towards the centre of the blade, ie approaching the common point 18, the passages 8 are almost perpendicular to the wall 2, i.e. are inclined at an angle of approximately 0°. The passages 8 between these two extremes are at continuously varying angles of inclination.

Although the invention has been described with reference to the passages 8 at the leading edge of the vane, the same arrangement may be employed for the passages 10 and 12 in the pressure and suction side walls of the vane. Thus, as viewed transversely of the aerofoil portion (FIG. 1), the passages 10 and 12 would appear to extend perpendicular to the local orientation of the side wall 2. However, as viewed in a plane containing the direction of each row of holes 10, 12, corresponding to FIG. 6, the passages 8 would be inclined at continuously varying angles. While such passages 10 and 12 in the side walls of the vane would not provide optimised mixing characteristics with the gas flow over the vane, the axial length of the side wall required to accommodate each row of passages 10, 12 would be decreased, enabling closer spacing of adjacent rows of passages.

FIGS. 7 and 8 illustrate a further improvement that can be achieved. FIG. 7 illustrates adjacent rows 28, 30 of passages 8. As is conventional, corresponding holes 8 in each row lie directly downstream of one another, with respect to the direction of flow of working gas over the surface of the vane. Consequently, there is a danger that regions of the vane surface lying between adjacent holes in each row will be inadequately cooled. In accordance with a further embodiment of the present invention, the passages 8 of the downstream row 30 are offset laterally (and, for this embodiment, "radially") from the passages 8 of the upstream row 28, with respect to the flow direction 32 over the surface of the vane. It is consequently possible to achieve more even cooling over the full surface of the side walls of the vane.

The invention claimed is:

1. An air-cooled component having a wall provided with cooling passages extending through the wall, the cooling passages being disposed in a row, whereby the angle between each passage and a plane perpendicular to the direction of the row varies with the position of the passage along the row, the passages being disposed in two groups, extending in opposite directions from a common point along the row, the passages in each group being inclined to the said plane in the opposite sense from those in the other group, the component having a hollow aerofoil portion, the passages extending from the interior of the aerofoil portion to the exterior of the component, wherein an internal partition is disposed within the interior of the aerofoil portion, substantially at the level of the common point.

2. A component as claimed in claim 1, wherein the angle of inclination increases in the direction along the row away from the common point.

3. A component as claimed in claim 2, wherein the angle increases from approximately 0° to approximately 60°.

4. A component as claimed in claim 1, wherein each passage is inclined at a different angle to the said plane from the other passages of that row.

5. A component as claimed in claim 1, wherein the row of passages extends in the spanwise direction of the aerofoil portion.

6. A component as claimed in claim 1, wherein the passages emerge at a leading edge of the aerofoil portion.

7. A component as claimed in claim 1, wherein the directions of the passages converge towards a region disposed upstream of the aerofoil portion.

8. A component as claimed in claim 1, wherein the common point is approximately midway along the aerofoil portion in the spanwise direction.

9. A component as claimed in claim 8, wherein cooling air supply is provided at each of the opposite ends of the aerofoil portion.

10. A component as claimed in claim 1, wherein the row of passages comprises an upstream row, a downstream row being situated in the wall downstream of the upstream row, passages of the downstream row being offset with respect to the passages in the upstream row laterally of the flow direction of cooling air, in use, along the wall from the respective holes of the upstream row.

* * * * *